US006598582B1

(12) United States Patent
Murawsky

(10) Patent No.: US 6,598,582 B1
(45) Date of Patent: Jul. 29, 2003

(54) ROTARY HEAT ENGINE

(75) Inventor: Ronald F Murawsky, 2320 Hawthorne Dr., Clearwater, FL (US) 33763

(73) Assignee: Ronald F Murawsky, Clearwater, FL (US)

( * ) Notice: Subject to any disclaimer, the term of this patent is extended or adjusted under 35 U.S.C. 154(b) by 0 days.

(21) Appl. No.: 09/977,657

(22) Filed: Oct. 15, 2001

(51) Int. Cl.[7] ..... F02B 53/00

(52) U.S. Cl. ..... 123/243; 123/46 R; 418/132; 418/111

(58) Field of Search ..... 418/229, 233, 418/132, 111, 137, 230; 123/46 R, 243

(56) References Cited

U.S. PATENT DOCUMENTS 3,683,694 A * 8/1972 Granberg ..... 418/29
3,743,451 A * 7/1973 Chapman ..... 418/111
3,902,829 A * 9/1975 Burrowes ..... 418/230
4,168,941 A * 9/1979 Rettew ..... 418/137
4,618,318 A * 10/1986 Hansen ..... 418/111
4,665,703 A * 5/1987 David ..... 123/46 R
6,050,796 A * 4/2000 Wong et al. ..... 418/132

FOREIGN PATENT DOCUMENTS

WO WO 98/57038 * 12/1998 ..... 123/243

* cited by examiner

*Primary Examiner*—Thomas Denion
*Assistant Examiner*—Thai-Ba Trieu

(57) ABSTRACT

An enclosed chamber external combustion rotary engine that converts thermal energy into mechanical energy, comprising of a tapered rotary disc with at least one perimeter quadrilateral vane oscillating inside enclosed expansion chambers formed on alternating sides of the rotary disc. The quadrilateral vane remains centered on the rotary disc, except for the transitional area, allowing fluid to provide force to the top and bottom sections of the quadrilateral vane for the length of the non-transition area. Fluid enters expansion chambers through one or more intake passages. Intake passages are formed with shut-off valves, which control the flow of fluid entering expansion chambers. Fluid pressure propels the vane through the expansion chambers causing the disc to rotate about an axis. Incorporated in the rotary disc is an output shaft from which work can be derived.

1 Claim, 7 Drawing Sheets

ROTARY HEAT ENGINE

FIELD OF THE INVENTION

This invention relates to enclosed chamber rotary heat engines.

DESCRIPTION OF THE RELATED ART

Machines comprised of rotating turbine blades utilizing high-pressure fluid commonly known as "steam turbines". The direction steam travels into a steam turbine is parallel to the turbine blade's axis. Consequently the turbine blades are slanted so the steam molecules hit the turbine blades and bounce off at an angle and it is this reactionary force which rotates the turbine blades. Steam molecules do not bounce off at right angles to the direction, which the turbine blades travels, this diminishes the torque value considerably. It is this fact that attributes to the steam turbine inherent inefficiency.

Further more turbine blades are required to be made from relativity thin material this makes them weak and susceptible to the harsh effects of high-pressure steam.

SUMMARY

This invention relates to a enclosed chamber rotary heat engine that converts thermal energy into mechanical energy. Comprising of a taper rotary disc with at least one perimeter vane oscillating inside enclosed expansion chambers formed on alternating sides of the disc. Expansion chamber walls have in part curved transition sections. The vane travels through expansion chambers centered on the rotary disc, excluding the transition area. This enables fluid to contact both sides of the vanes for the total length of the non transitional area resulting in a more even force exerted on the vanes. One expansion chamber continues around the total perimeter excluding the transition area. Fluid enters expansion chambers through at least one intake passage. One intake passage located near the beginning of the expansion chamber and subsequent intake passages located in linear progression. Intake passages are formed with shut off valves to stop and start the flow of fluid. Means to control shut off valves is provided. Fluid pressure propels vanes through expansion chambers causing the disc to rotate about its axis.

BRIEF DESCRIPTIONS OF THE DRAWINGS

DETAILED DESCRIPTION

Figure 1:
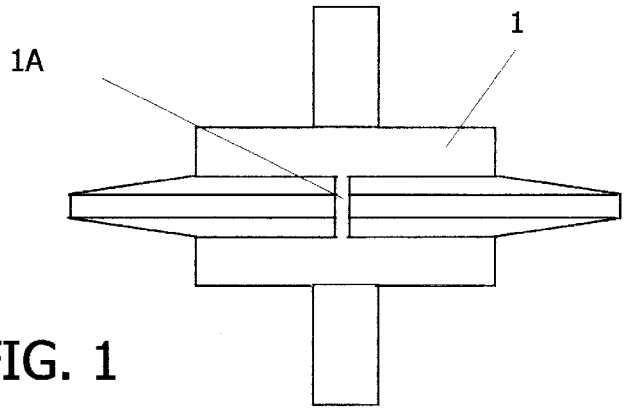
FIG. 1 is a side view of a rotary disc.

FIG. 1 Shows rotary disc 1 formed with at least one radial slot 1A which opens through its peripheral edge. Disc 1 outer plane which encompasses slots 1A is wider on its inner diameter and gradually gets thinner towards its outer diameter. Disc 1 inner sealing wall is cylindrical.

Figure 2:
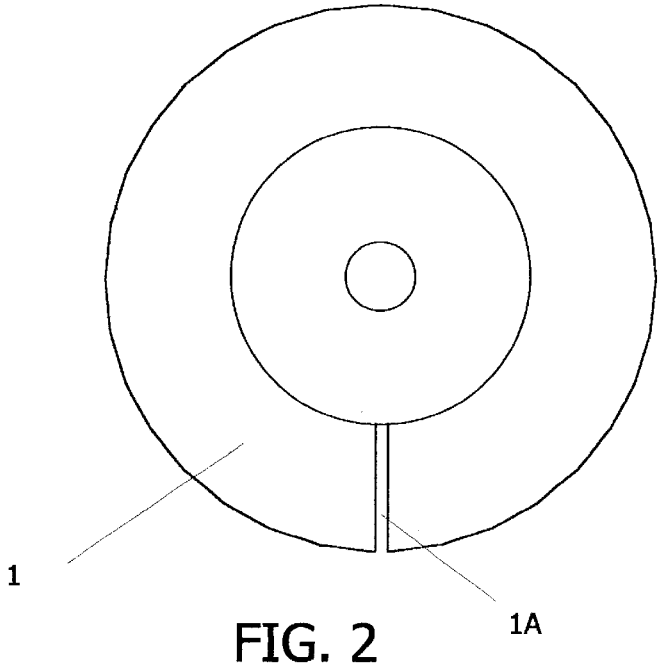
FIG. 2 is a top view of a rotary disc.

FIG. 2 Shows top view of disc 1 formed with slot 1A.

Figure 3:
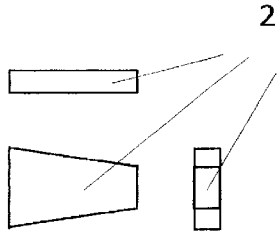
FIG. 3 is front view, top view and side view of a vane.

FIG. 3 Shows front view, top view and end view of vane 2. Vane 2 inner and outer sides are parallel to each other. Quadrilateral vane 2 extends through slots 1A. Vane 2 slides back and forth in slots 1A parallel to disc 1 axis. Vane 2 provides a sealing means which prevents the leakage of fluid.

Figure 4:
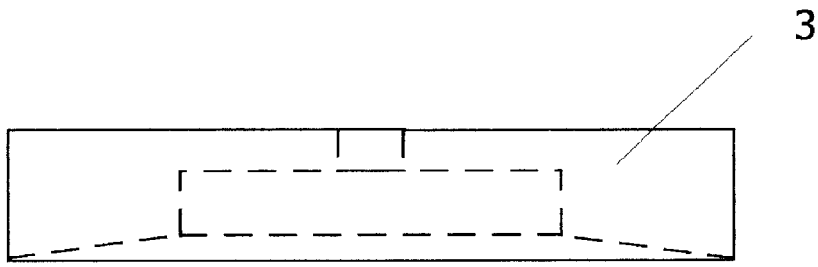
FIG. 4 is a side view of top and bottom chamber walls.

FIG. 4 Shows front view of chamber walls 3. Two required, provides the upper and lower sealing surface for vanes 2. In transition area 8 and 9 chamber walls 3 and disc 1 provide a sealing means which prevent the leakage of fluid. Chamber walls 3 have in part a curved transition section. Chamber walls 3 may house one or more intake passages 5C, 5D, 5E, 5F and one or more exhaust passages 5A, 5B.

Figure 5:
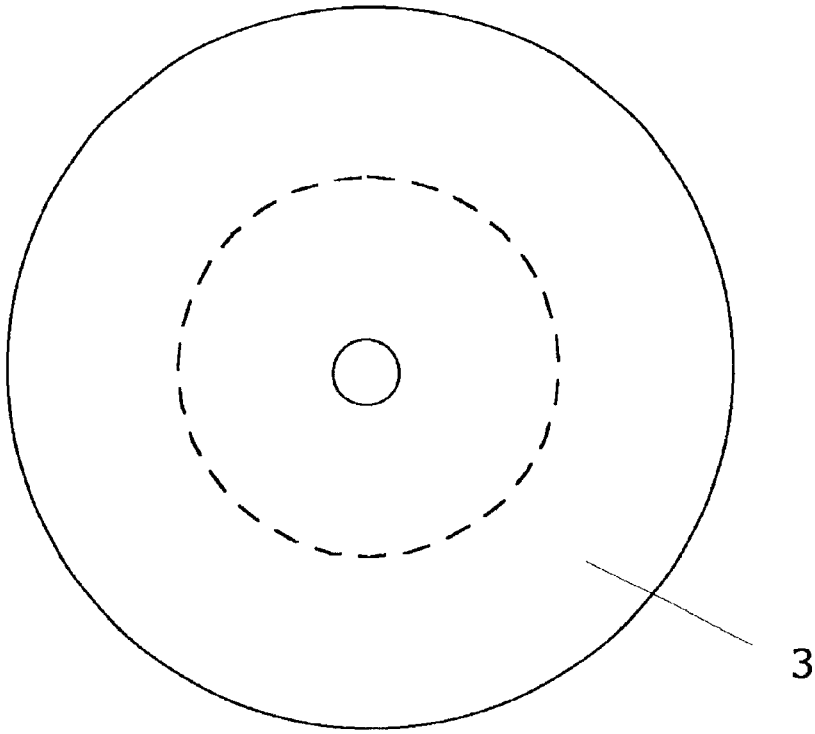
FIG. 5 is a top view of top and bottom chambers walls.

FIG. 5 Shows top view of chamber wall 3.

Figure 6:
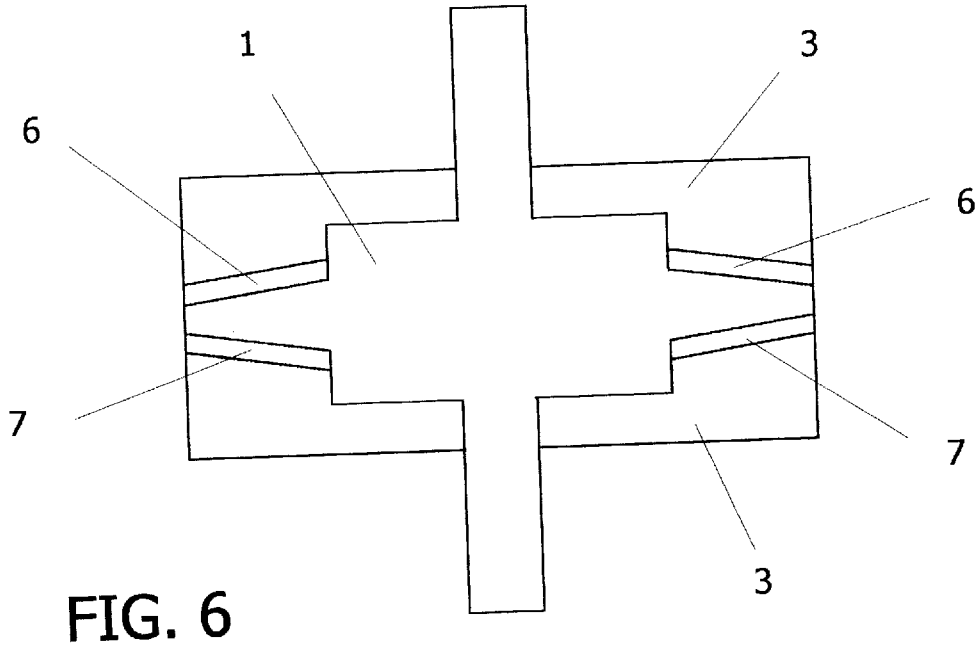
FIG. 6 is a cross-sectional composite view of the rotary disc and top and bottom chamber walls.

FIG. 6 Shows front view of chamber walls 3 which form two or more alternating parallel expansion chambers 6 and 7 on opposite sides of disc 1.

Figure 7:
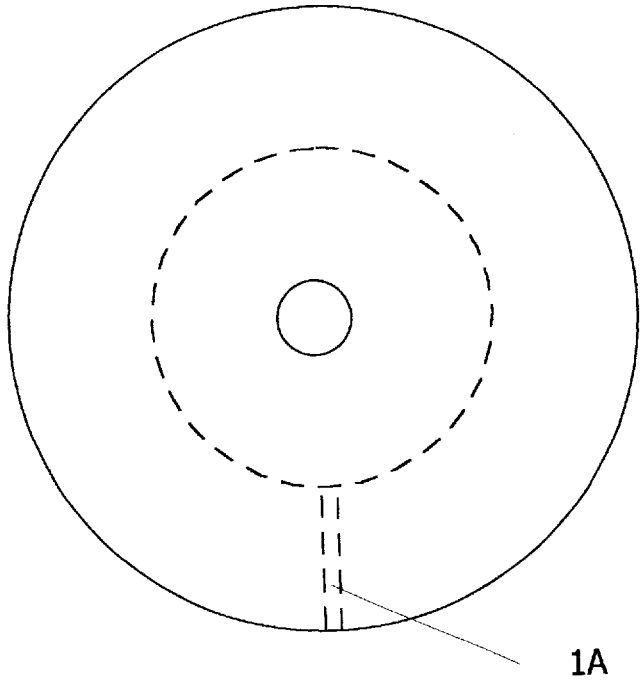
FIG. 7 is a top view of the composite rotary disc and top and bottom chamber walls.

FIG. 7 Shows top view of chamber wall 3 and disc 1 assembled.

Figure 8:
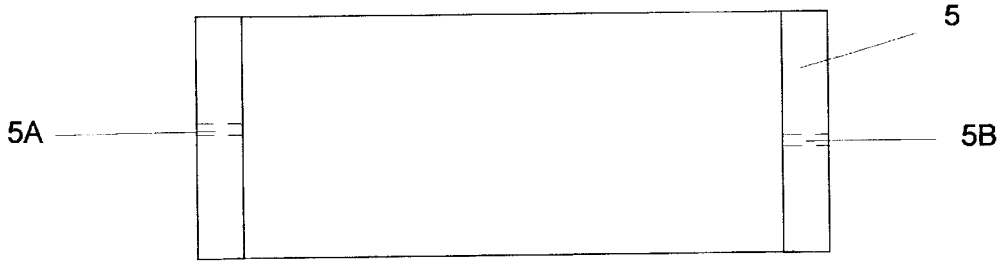
FIG. 8 is a side view of the outer chamber wall.

FIG. 8 Shows front view of outer chamber wall 5 providing an outer enclosure for expansion chamber 6 and 7. Outer chamber wall 5 inner surface is cylindrical. Housed in the perimeter of outer chamber wall 5 is intake passages 5C, 5D, 5E, 5F. and exhaust passages 5A and 5B. Intake passages 5C, 5D, 5E, 5F are aligned such that the incoming fluid is aligned with the direction vanes 2 travel. One intake passage 5C and 5E is located near the beginning of expansion chambers 6 and 7 and subsequent intake passages 5D and 5F are arranged in linear progression.

Exhaust passages 5A and 5B are aligned to the direction of the escaping fluid.

Figure 9:
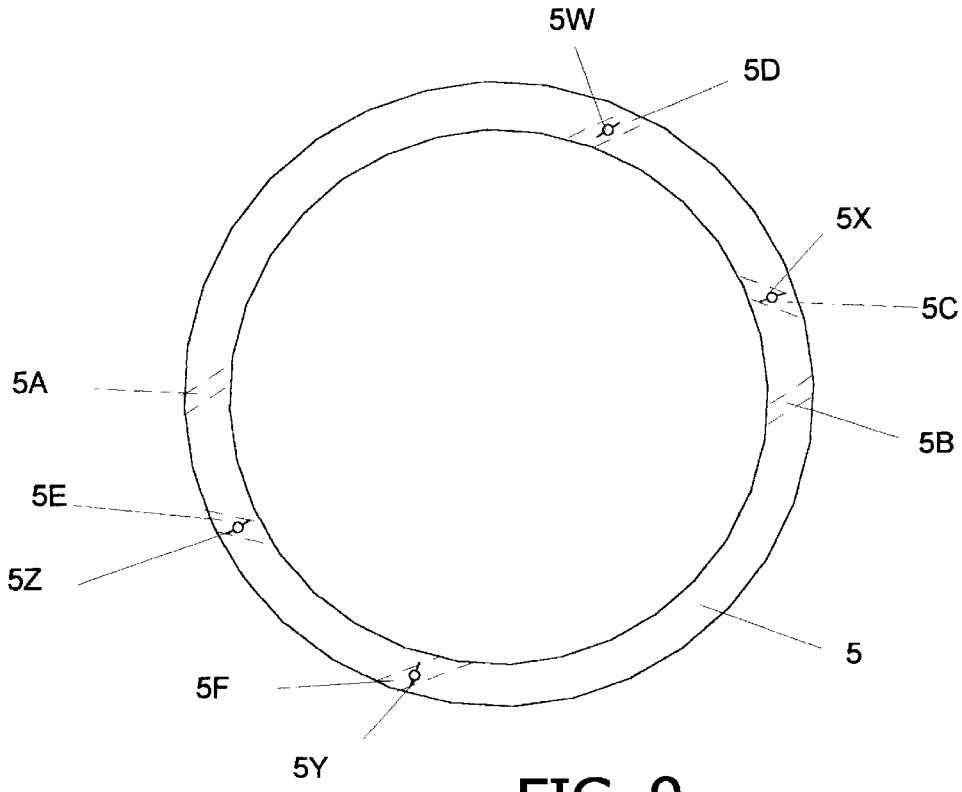
FIG. 9 is a top view of the outer chamber wall.

FIG. 9 Shows top view of outer chamber wall 5.

Figure 10:
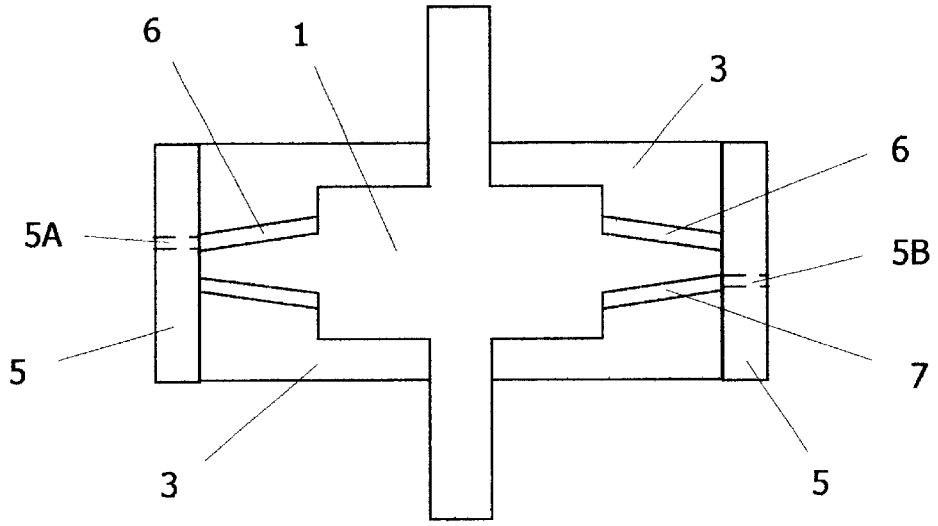
FIG. 10 is a sectional view of a rotary heat engine.

FIG. 10 Shows front view of all major parts assembled.

Figure 11:
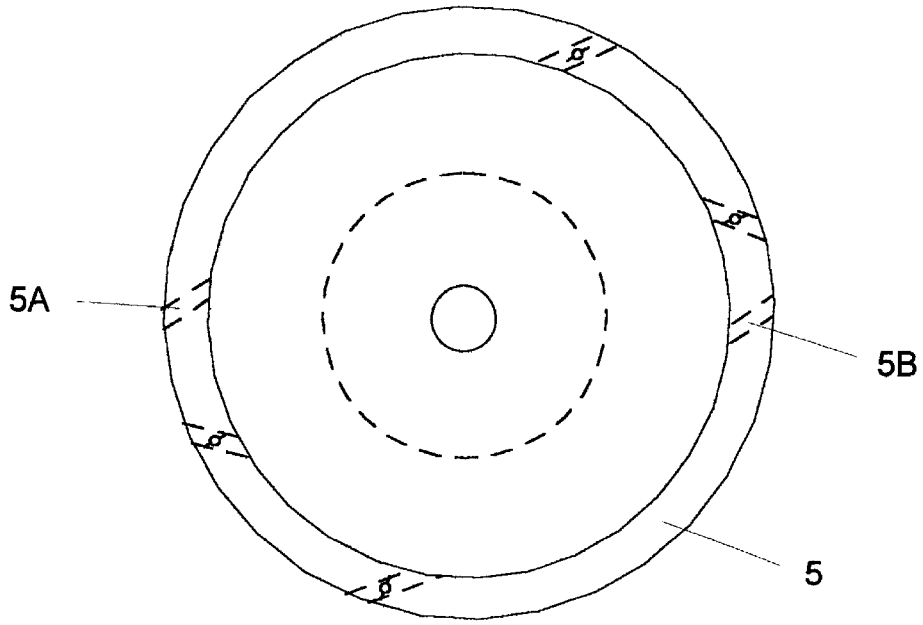
FIG. 11 is a top view of a rotary heat engine.

FIG. 11 Shows top view of all major parts assembled.

Figure 12:
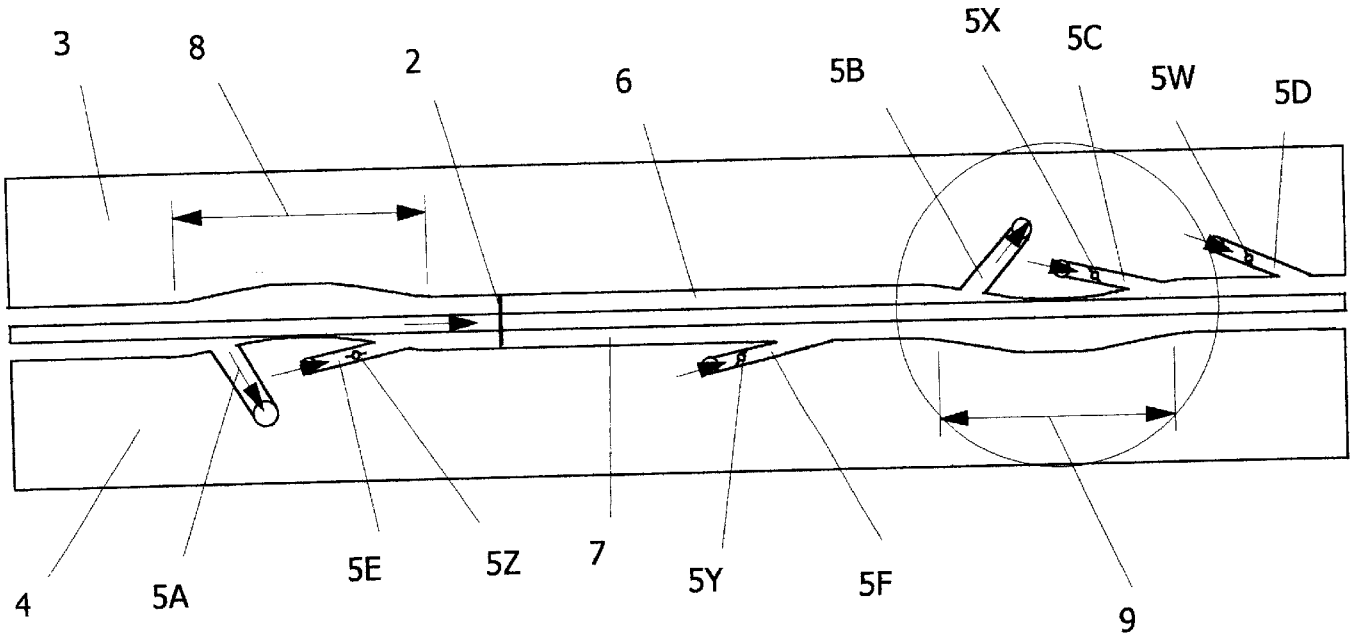
FIG. 12 is an elongated sectional view of a rotary heat engine.

FIG. 12 Shows a elongated drawing with disc 1 and vanes 2 rotating through expansion chambers 6 and 7. Volume increases in chambers 6 and 7 behind vanes 2 and volume decreases in chambers 6 and 7 in front of vanes 2. Pressurized fluid enters intake passage 5E increasing pressure behind vane 2, propelling vane 2 from left to right. All intake passages 5C, 5D, 5E, 5F have housed within shut off valves 5W, 5X, 5Y, 5Z to stop and start the flow of fluid. Shut off valves 5W, 5X, 5Y, 5Z are timed to shut off and open at predetermined intervals. As vanes 2 travel through expansion chambers 6 and 7 shut off valves 5W, 5X, 5Y, 5Z are turned on individually when the vane 2 pass each respective intake passages 5C, 5D, 5E, 5F. When vane 2 reaches a predetermined location, shut off valves 5W, 5X, 5Y, 5Z are shut off allowing the existing fluid in expansion chambers 6 and 7 time to expand. Vane 2 remains centered on disc 1 allowing pressurized fluid to be in contact with both sides of vane 2 for the length of the non-transition area.

Figure 13:
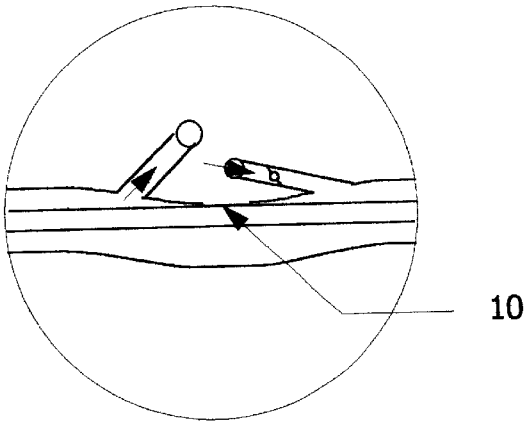
FIG. 13 is an inset sectional view of a rotary heat engine.

FIG. 13 Shows inset figure of transition area 9. In transition area 8 and 9 chamber walls 3 and disc 1 provide a sealing means, which prevents the leakage of fluid.

FIGS. 14–18 relates to an elongated diagram where power disc 1 and vane 2 move from left to right.

Figure 14:
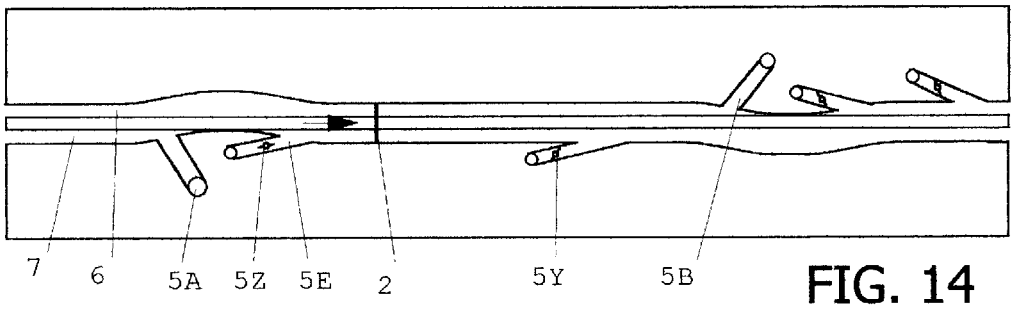
FIG. 14–FIG. 18 are elongated sectional views of a rotary heat engine in various modes of operation.

FIG. 14 Shows vane 2 has just passed intake passage 5E, intake valve 5Z is open, intake passage 5Y is closed. Pressurized fluid enters intake passage 5E and proceeds into expansion chamber 7 exerting force on the lower area of vane 2 propelling it to the right. Existing pressurized fluid is in expansion chamber 6 exerting force on the upper area of vane 2. In expansion chamber 6 and 7 to the right of vane. 2 contains relatively low pressurized fluid because exhaust passages 5A and 5B are exposed to atmospheric pressure.

Figure 15:
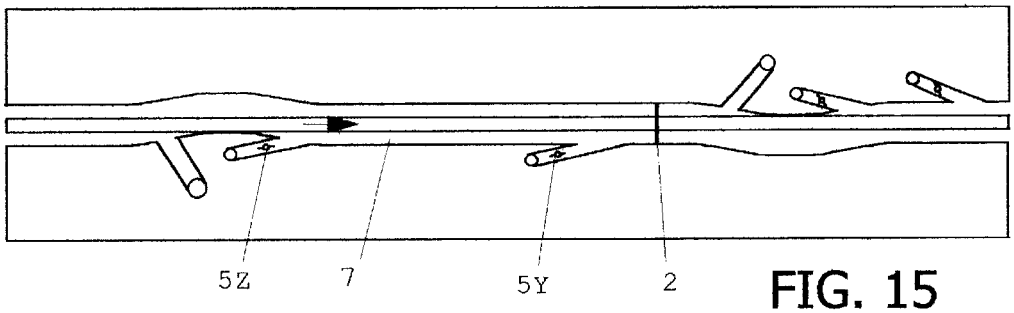

FIG. 15 Both intake valves 5Z and 5Y are now open and pressurized fluid builds in expansion chamber 7 propelling vane 2 to the right.

Figure 16:
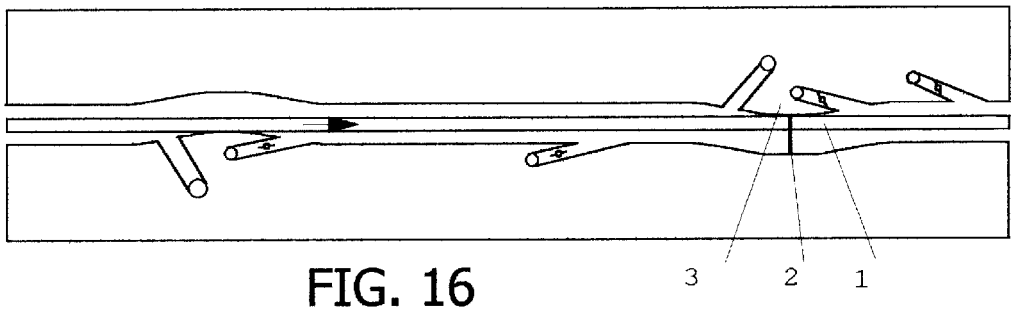

FIG. 16 Vane 2 reaches transition area 9 where chamber wall 3 and disc 1 provides sealing means which prevents the leakage of fluid.

Figure 17:
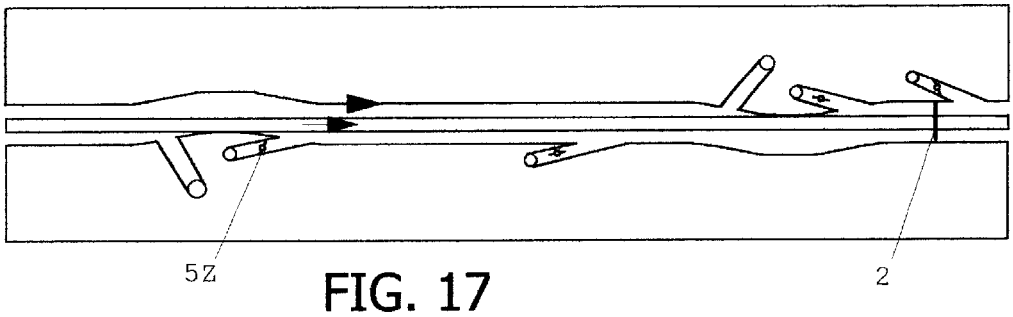

FIG. 17 When vane 2 reaches a predetermined location intake valve 5Z closes.

Figure 18:
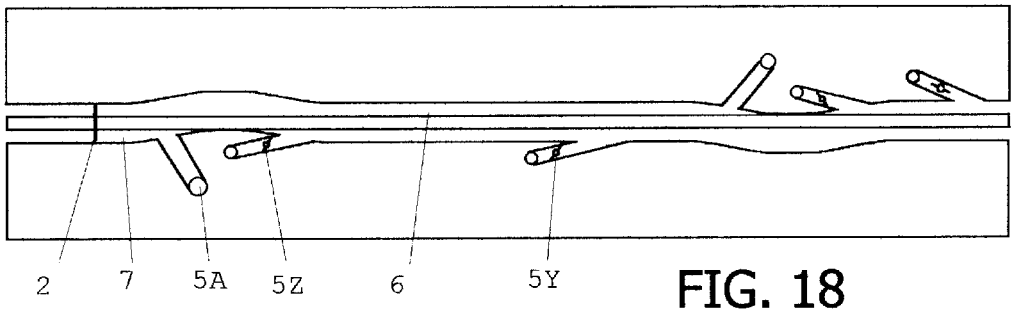

FIG. 18 Vane 2 has moved toward the end of expansion chamber 6. Both intake valves 5Z AND 5Y are closed allowing existing pressurized fluid time to expand. Excess pressurized fluid is being pushed out exhaust passage 5A by the front of vane 2. The same process occurs in both expansion chambers 6 and 7. The cycle now repeats itself.

What is claimed is:

1. An enclosed chamber external combustion engine comprises:

a rotary disc having radial slots formed in the perimeter;

an outer plane of said disc which encompasses said slots, being thinner on the outer diameter and progressively getting thicker towards the inner diameter;

quadrilateral vanes fitting in said slots and having inner and outer sides of said quadrilateral vanes being parallel;

said quadrilateral vanes being adapted to move parallel to the rotary disc axis while rotating through expansion chambers, and having seal fluid while passing through said expansion chambers;

said quadrilateral vanes remaining centered on said rotary disc, allowing pressurized fluid to be in contact with top and bottom sections of said quadrilateral vanes for the length of a non transitional area;

both chamber walls forming alternating parallel chambers on opposite sides of said rotary disc and having at least one intake passage and at least one exhaust passage;

a sealing means provided in areas of said chamber walls for preventing said disc and said quadrilateral vanes from fluid leakage;

a perimeter plane of said rotary disc acting as a midway border between said expansion chambers comprising:

an outer surface of said rotary disc forming a cylindrical inner chamber wall;

an outer chamber wall providing an outer enclosure for said expansion chambers;

an inner surface of said outer chamber wall being cylindrical;

said outer chamber wall having intake passages and exhaust passages on the perimeter plane;

wherein said intake passages are aligned such that the incoming fluid is aligned with the direction quadrilateral vanes, at least one said intake passage being located near the beginning of said expansion chamber and subsequent intake passages being arranged in linear progression; and wherein said exhaust passages are aligned to the direction of the escaping fluid;

shut-off valves provided in said intake passages, which stop and start the flow of fluid; and means for regulating said shut-off valves being provided.

* * * * *